US012044122B2

(12) United States Patent
Jarrot et al.

(10) Patent No.: US 12,044,122 B2
(45) Date of Patent: Jul. 23, 2024

(54) DATA RATE MISMATCH ADVISOR

(71) Applicant: Schlumberger Technology Corporation, Sugar Land, TX (US)

(72) Inventors: Arnaud Jarrot, Clamart (FR); David Kirk Conn, Katy, TX (US); Pavel Annenkov, Houston, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 17/808,772

(22) Filed: Jun. 24, 2022

(65) Prior Publication Data

US 2022/0412211 A1 Dec. 29, 2022

Related U.S. Application Data

(60) Provisional application No. 63/202,788, filed on Jun. 24, 2021.

(51) Int. Cl.
*E21B 47/12* (2012.01)

(52) U.S. Cl.
CPC ..... *E21B 47/12* (2013.01)

(58) Field of Classification Search
CPC ..... E21B 47/12; E21B 47/14; E21B 47/16; E21B 47/18; E21B 47/20; E21B 47/22; E21B 47/24
See application file for complete search history.

(56) References Cited

U.S. PATENT DOCUMENTS 5,272,680 A 12/1993 Stone et al.
9,334,725 B2 * 5/2016 Sitka ..... E21B 47/24
9,755,869 B2 * 9/2017 Anthony ..... H04L 27/0006
(Continued)

FOREIGN PATENT DOCUMENTS

CN 106130942 A * 11/2016 ..... H04L 27/0012
WO 2015027340 A1 3/2015
(Continued)

OTHER PUBLICATIONS

Sobolewski et al., "Automatic Modulation Recognition Techniques Based on Cyclostationary and Multifractal Features For Distinguishing LFM, PWM and PPM Waveforms Used in Radar Systems as Example of Artificial Intelligence Implementation in Test", Oct. 22, 2012, 2012 IEEE Autotestcon Proceedings. (Year: 2012).*
(Continued)

*Primary Examiner* — Franklin D Balseca
(74) *Attorney, Agent, or Firm* — Aashish Y. Chawla

(57) ABSTRACT

A method, a non-transitory computer-readable medium, and a computing system are provided for determining a telemetry mode of a signal. A drilling telemetry signal is received from a downhole tool in a wellbore. A transformation is determined based at least partially upon the drilling telemetry signal. Multiple features are extracted based at least partially upon the transformation. A decision region is identified based at least partially upon the features. A telemetry parameter is identified based at least partially upon the decision region. A telemetry mode of the drilling telemetry signal is determined based at least partially upon the telemetry parameter. The drilling telemetry signal is decoded based at least partially upon the telemetry mode.

19 Claims, 7 Drawing Sheets

(56) References Cited

U.S. PATENT DOCUMENTS

| | | | | |
|---|---|---|---|---|
| 10,051,475 | B2 * | 8/2018 | Shattil | H04L 43/18 |
| 10,534,799 | B1 * | 1/2020 | Gupta | G06N 5/045 |
| 10,855,604 | B2 * | 12/2020 | Tigli | H04L 43/022 |
| 11,539,568 | B2 * | 12/2022 | Chermon | H04B 1/1027 |
| 2009/0225887 | A1 * | 9/2009 | Sutton | H04L 27/2647 375/267 |
| 2014/0307767 | A1 * | 10/2014 | Anantha | H04L 27/0012 375/232 |
| 2019/0376384 | A1 | 12/2019 | Kusuma et al. | |
| 2020/0291768 | A1 | 9/2020 | Kusuma et al. | |
| 2021/0115787 | A1 * | 4/2021 | Conn | E21B 47/14 |

FOREIGN PATENT DOCUMENTS

| | | | | |
|---|---|---|---|---|
| WO | 2018080462 | A1 | 5/2018 | |
| WO | WO-2021082469 | A1 * | 5/2021 | H04L 27/0012 |

OTHER PUBLICATIONS

Search Report and Written Opinion of International Patent Application No. PCT/US2022/034956 dated Oct. 7, 2022, 8 pages.

Wikipedia contributors, "Spectral correlation density", in Wikipedia, The Free Encyclopedia, Retrieved 5:43 P.M., Aug. 26, 2022, from [https://en.wikipedia.org/w/index.php?title=Spectral_correlation_density&oldid=942728379], Feb. 26, 2020, 3 pages.

Wikipedia contributors, "Support vector machine", in Wikipedia, The Free Encyclopedia, Retrieved 5:46 P.M., Aug. 26, 2022, from [https://en.wikipedia.org/w/index.php?title=Support_vector_machine&oldid=991142258], Nov. 28, 20220, 20 pages.

* cited by examiner

DATA RATE MISMATCH ADVISOR

CROSS-REFERENCE TO RELATED APPLICATIONS

This application claims priority to U.S. Provisional Patent Application No. 63/202,788, filed on Jun. 24, 2021 and titled "Data Rate Mismatch Advisor", the entirety of which is incorporated by reference.

BACKGROUND

In mud pulse telemetry, a telemetry signal is transmitted from a downhole tool in a wellbore up to a receiver at the surface. The telemetry signal is encoded for transmission. The telemetry signal may have parameters such as: modulation type, carrier frequency, and symbol rate. These parameters are used to decode the telemetry signal at the surface. However, in some instances, these parameters may be unknown. For example, the parameters can be unknown due to human error. More particularly, the parameters can be accidentally changed through an unintended downlink command to the downhole tool. In such a case, the telemetry signal may not be decoded. As a result, it may be challenging for field engineers to troubleshoot the issue and determine the parameters values. This may result in non-productive time (NPT) at the wellsite.

SUMMARY

Embodiments of the disclosure may provide a method for determining a telemetry mode of a signal. According to the method, a drilling telemetry signal is received from a downhole tool in a wellbore. A transformation is determined based at least partially upon the drilling telemetry signal. Multiple features are extracted based at least partially upon the transformation. A decision region is identified based at least partially upon the features. A telemetry parameter is identified based at least partially on the decision region. The telemetry mode of the drilling telemetry signal is determined based at least partially upon the telemetry parameter. The drilling telemetry signal is decoded based at least partially upon the telemetry mode.

In an embodiment, the drilling telemetry signal may be a mud pulse telemetry signal or an electric potential telemetry signal.

In an embodiment, the method may include automatically configuring a receiver to receive drilling telemetry signals using the determined telemetry mode.

In an embodiment, the drilling telemetry signal may be received at or near a surface of the wellbore.

In an embodiment, the decision region may be identified by a classifier, and the classifier may include a support vector machine.

In an embodiment, the decision region may be identified by a classifier, and the classifier may include a random forest classifier or a Naïve Bayes classifier.

In an embodiment, the method may include training a classifier based on using a variety of traces with known classifications. Parameters of the classifier may be iteratively modified such that output of the classifier reflects a class associated with a current trace. The training and the iteratively modifying may be repeated until the classifier reaches a desired level of accuracy.

Embodiments of the disclosure may also provide a non-transitory computer-readable medium. The medium stores instructions that, when executed by at least one processor of a computing system, cause the computing system to perform operations. The operations include receiving a drilling telemetry signal from a downhole tool in a wellbore. The operations also include determining a transformation based at least partially upon the drilling telemetry signal. The operations also include extracting multiple features based at least partially upon the transformation. The operations also include identifying a decision region based at least partially upon the features. The operations also include identifying a telemetry parameter based at least partially upon the decision region. The operations also include determining the telemetry mode of the drilling telemetry signal based at least partially upon the telemetry parameter. The operations also include decoding the signal based at least partially upon the telemetry mode.

Embodiments of the disclosure may further provide a computing system. The computing system includes one or more processors and a memory system. The memory system includes one or more non-transitory computer-readable media storing instructions that, when executed by at least one of the one or more processors, cause the computing system to perform operations. The operations include receiving a drilling telemetry signal from a downhole tool in a wellbore. The operations also include determining a transformation based at least partially upon the drilling telemetry signal. The operations also include extracting multiple features based at least partially upon the transformation. The operations also include identifying a decision region based at least partially upon the features. The operations also include identifying a telemetry parameter based at least partially upon the decision region. The operations also include determining a telemetry mode of the drilling telemetry signal based at least partially upon the telemetry parameter. The operations also include decoding the signal based at least partially upon the telemetry mode.

It will be appreciated that this summary is intended merely to introduce some aspects of the present methods, systems, and media, which are more fully described and/or claimed below. Accordingly, this summary is not intended to be limiting.

BRIEF DESCRIPTION OF THE DRAWINGS

The accompanying drawings, which are incorporated in and constitute a part of this specification, illustrate embodiments of the present teachings and together with the description, serve to explain the principles of the present teachings. In the figures.

DETAILED DESCRIPTION

Reference will now be made in detail to embodiments, examples of which are illustrated in the accompanying drawings and figures. In the following detailed description, numerous specific details are set forth in order to provide a thorough understanding of the invention. However, it will be apparent to one of ordinary skill in the art that the invention may be practiced without these specific details. In other instances, well-known methods, procedures, components, circuits, and networks have not been described in detail so as not to unnecessarily obscure aspects of the embodiments.

It will also be understood that, although the terms first, second, etc. may be used herein to describe various elements, these elements should not be limited by these terms. These terms are only used to distinguish one element from another. For example, a first object or step could be termed a second object or step, and, similarly, a second object or step could be termed a first object or step, without departing from the scope of the present disclosure. The first object or step, and the second object or step, are both, objects or steps, respectively, but they are not to be considered the same object or step.

The terminology used in the description herein is for the purpose of describing particular embodiments and is not intended to be limiting. As used in this description and the appended claims, the singular forms "a," "an" and "the" are intended to include the plural forms as well, unless the context clearly indicates otherwise. It will also be understood that the term "and/or" as used herein refers to and encompasses any possible combinations of one or more of the associated listed items. It will be further understood that the terms "includes," "including," "comprises" and/or "comprising," when used in this specification, specify the presence of stated features, integers, steps, operations, elements, and/or components, but do not preclude the presence or addition of one or more other features, integers, steps, operations, elements, components, and/or groups thereof. Further, as used herein, the term "if" may be construed to mean "when" or "upon" or "in response to determining" or "in response to detecting," depending on the context.

Attention is now directed to processing procedures, methods, techniques, and workflows that are in accordance with some embodiments. Some operations in the processing procedures, methods, techniques, and workflows disclosed herein may be combined and/or the order of some operations may be changed.

Figure 1:
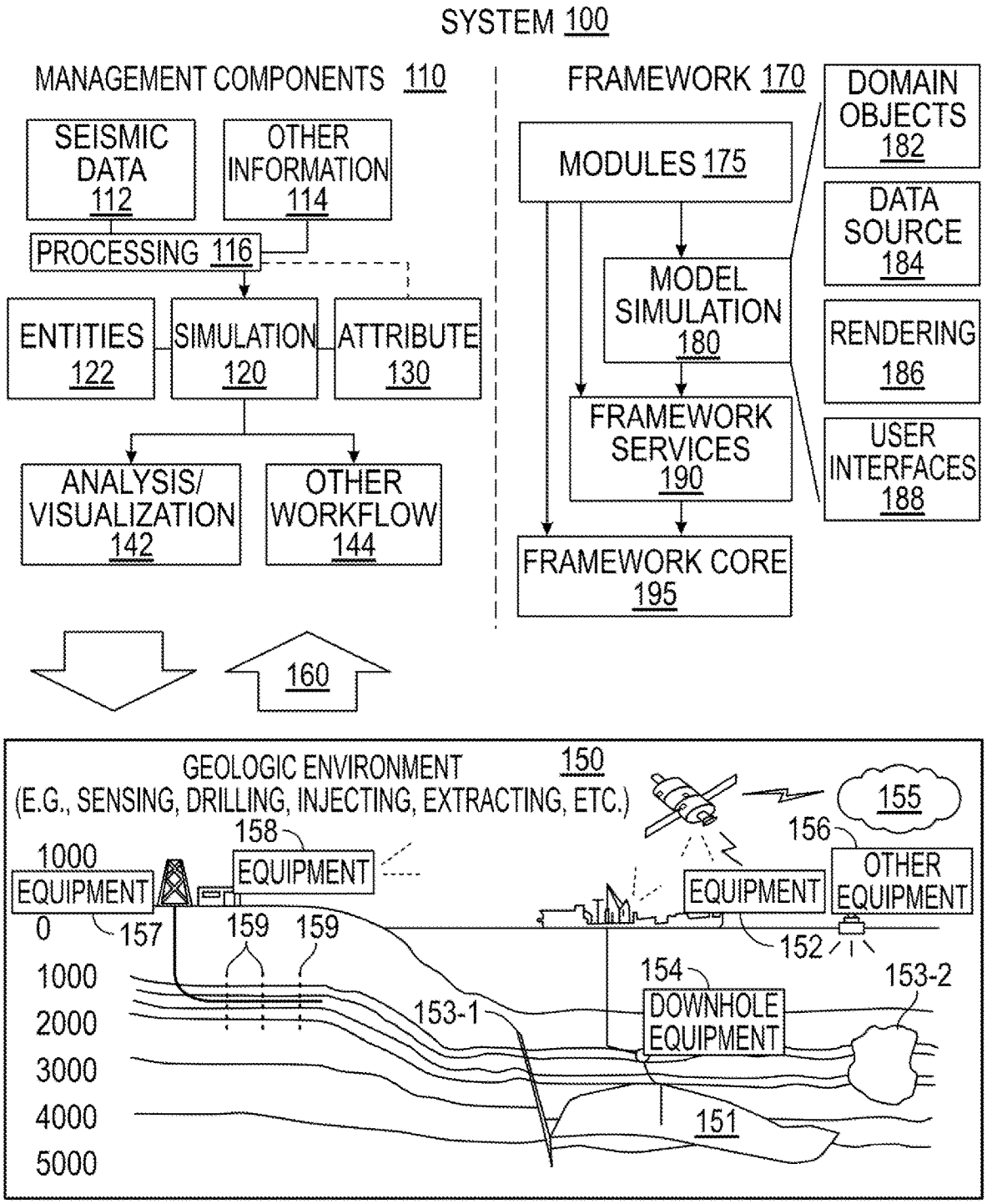
FIG. 1 illustrates an example of a system that includes various management components to manage various aspects of a geologic environment, according to an embodiment.

FIG. 1 illustrates an example of a system 100 that includes various management components 110 to manage various aspects of a geologic environment 150 (e.g., an environment that includes a sedimentary basin, a reservoir 151, one or more faults 153-1, one or more geobodies 153-2, etc.). For example, the management components 110 may allow for direct or indirect management of sensing, drilling, injecting, extracting, etc., with respect to the geologic environment 150. In turn, further information about the geologic environment 150 may become available as feedback 160 (e.g., optionally as input to one or more of the management components 110).

In the example of FIG. 1, the management components 110 include a seismic data component 112, an additional information component 114 (e.g., well/logging data), a processing component 116, a simulation component 120, an attribute component 130, an analysis/visualization component 142 and a workflow component 144. In operation, seismic data and other information provided per the components 112 and 114 may be input to the simulation component 120.

In an example embodiment, the simulation component 120 may rely on entities 122. Entities 122 may include earth entities or geological objects such as wells, surfaces, bodies, reservoirs, etc. In the system 100, the entities 122 can include virtual representations of actual physical entities that are reconstructed for purposes of simulation. The entities 122 may include entities based on data acquired via sensing, observation, etc. (e.g., the seismic data and other information). An entity may be characterized by one or more properties (e.g., a geometrical pillar grid entity of an earth model may be characterized by a porosity property). Such properties may represent one or more measurements (e.g., acquired data), calculations, etc.

In an example embodiment, the simulation component 120 may operate in conjunction with a software framework such as an object-based framework. In such a framework, entities may include entities based on pre-defined classes to facilitate modeling and simulation. A commercially available example of an object-based framework is the MICROSOFT® .NET® framework (Redmond, Washington), which provides a set of extensible object classes. In the .NET® framework, an object class encapsulates a module of reusable code and associated data structures. Object classes can be used to instantiate object instances for use in by a program, script, etc. For example, borehole classes may define objects for representing boreholes based on well data.

In the example of FIG. 1, the simulation component 120 may process information to conform to one or more attributes specified by the attribute component 130, which may include a library of attributes. Such processing may occur prior to input to the simulation component 120 (e.g., consider the processing component 116). As an example, the simulation component 120 may perform operations on input information based on one or more attributes specified by the attribute component 130. In an example embodiment, the simulation component 120 may construct one or more models of the geologic environment 150, which may be relied on to simulate behavior of the geologic environment 150 (e.g., responsive to one or more acts, whether natural or artificial). In the example of FIG. 1, the analysis/visualization component 142 may allow for interaction with a model or model-based results (e.g., simulation results, etc.). As an example, output from the simulation component 120 may be input to one or more other workflows, as indicated by a workflow component 144.

As an example, the simulation component 120 may include one or more features of a simulator such as the ECLIPSE™ reservoir simulator (Schlumberger Limited, Houston Texas), the INTERSECT™ reservoir simulator (Schlumberger Limited, Houston Texas), etc. As an example, a simulation component, a simulator, etc. may include features to implement one or more meshless techniques (e.g., to solve one or more equations, etc.). As an example, a reservoir or reservoirs may be simulated with respect to one or more enhanced recovery techniques (e.g., consider a thermal process such as SAGD, etc.).

In an example embodiment, the management components 110 may include features of a commercially available framework such as the PETREL® seismic to simulation software framework (Schlumberger Limited, Houston, Texas). The PETREL® framework provides components that allow for optimization of exploration and development operations. The PETREL® framework includes seismic to simulation software components that can output information for use in increasing reservoir performance, for example, by improving asset team productivity. Through use of such a framework, various professionals (e.g., geophysicists, geologists, and reservoir engineers) can develop collaborative workflows and integrate operations to streamline processes. Such a framework may be considered an application and may be considered a data-driven application (e.g., where data is input for purposes of modeling, simulating, etc.).

In an example embodiment, various aspects of the management components 110 may include add-ons or plug-ins that operate according to specifications of a framework environment. For example, a commercially available framework environment marketed as the OCEAN® framework environment (Schlumberger Limited, Houston, Texas) allows for integration of add-ons (or plug-ins) into a PETREL® framework workflow. The OCEAN® framework environment leverages .NET® tools (Microsoft Corporation, Redmond, Washington) and offers stable, user-friendly interfaces for efficient development. In an example embodiment, various components may be implemented as add-ons (or plug-ins) that conform to and operate according to specifications of a framework environment (e.g., according to application programming interface (API) specifications, etc.).

FIG. 1 also shows an example of a framework 170 that includes a model simulation layer 180 along with a framework services layer 190, a framework core layer 195 and a modules layer 175. The framework 170 may include the commercially available OCEAN® framework where the model simulation layer 180 is the commercially available PETREL® model-centric software package that hosts OCEAN® framework applications. In an example embodiment, the PETREL® software may be considered a data-driven application. The PETREL® software can include a framework for model building and visualization.

As an example, a framework may include features for implementing one or more mesh generation techniques. For example, a framework may include an input component for receipt of information from interpretation of seismic data, one or more attributes based at least in part on seismic data, log data, image data, etc. Such a framework may include a mesh generation component that processes input information, optionally in conjunction with other information, to generate a mesh.

In the example of FIG. 1, the model simulation layer 180 may provide domain objects 182, act as a data source 184, provide for rendering 186 and provide for various user interfaces 188. Rendering 186 may provide a graphical environment in which applications can display their data while the user interfaces 188 may provide a common look and feel for application user interface components.

As an example, the domain objects 182 can include entity objects, property objects and optionally other objects. Entity objects may be used to geometrically represent wells, surfaces, bodies, reservoirs, etc., while property objects may be used to provide property values as well as data versions and display parameters. For example, an entity object may represent a well where a property object provides log information as well as version information and display information (e.g., to display the well as part of a model).

In the example of FIG. 1, data may be stored in one or more data sources (or data stores, generally physical data storage devices), which may be at the same or different physical sites and accessible via one or more networks. The model simulation layer 180 may be configured to model projects. As such, a particular project may be stored where stored project information may include inputs, models, results and cases. Thus, upon completion of a modeling session, a user may store a project. At a later time, the project can be accessed and restored using the model simulation layer 180, which can recreate instances of the relevant domain objects.

In the example of FIG. 1, the geologic environment 150 may include layers (e.g., stratification) that include a reservoir 151 and one or more other features such as the fault 153-1, the geobody 153-2, etc. As an example, the geologic environment 150 may be outfitted with any of a variety of sensors, detectors, actuators, etc. For example, equipment 152 may include communication circuitry to receive and to transmit information with respect to one or more networks 155. Such information may include information associated with downhole equipment 154, which may be equipment to acquire information, to assist with resource recovery, etc. Other equipment 156 may be located remote from a well site and include sensing, detecting, emitting or other circuitry. Such equipment may include storage and communication circuitry to store and to communicate data, instructions, etc. As an example, one or more satellites may be provided for purposes of communications, data acquisition, etc. For example, FIG. 1 shows a satellite in communication with the network 155 that may be configured for communications, noting that the satellite may additionally or instead include circuitry for imagery (e.g., spatial, spectral, temporal, radiometric, etc.).

FIG. 1 also shows the geologic environment 150 as optionally including equipment 157 and 158 associated with a well that includes a substantially horizontal portion that may intersect with one or more fractures 159. For example, consider a well in a shale formation that may include natural fractures, artificial fractures (e.g., hydraulic fractures) or a combination of natural and artificial fractures. As an example, a well may be drilled for a reservoir that is laterally extensive. In such an example, lateral variations in properties, stresses, etc. may exist where an assessment of such variations may assist with planning, operations, etc. to develop a laterally extensive reservoir (e.g., via fracturing, injecting, extracting, etc.). As an example, the equipment 157 and/or 158 may include components, a system, systems, etc. for fracturing, seismic sensing, analysis of seismic data, assessment of one or more fractures, etc.

As mentioned, the system 100 may be used to perform one or more workflows. A workflow may be a process that includes a number of worksteps. A workstep may operate on data, for example, to create new data, to update existing data, etc. As an example, a may operate on one or more inputs and create one or more results, for example, based on one or more algorithms. As an example, a system may include a workflow editor for creation, editing, executing, etc. of a workflow. In such an example, the workflow editor may provide for selection of one or more pre-defined worksteps, one or more customized worksteps, etc. As an example, a workflow may be a workflow implementable in the PETREL® software, for example, that operates on seismic data, seismic attribute(s), etc. As an example, a workflow may be a process implementable in the OCEAN® framework. As an example, a workflow may include one or more worksteps that access a module such as a plug-in (e.g., external executable code, etc.).

Data Rate Mismatch Advisor

Embodiments of the disclosure include systems and methods that provide automated, real-time telemetry mode detection for drilling telemetry signals including, but not limited to, mud pulse telemetry signals and electronic potential (EM) telemetry signals. More particularly, the systems and methods may identify the presence or absence of a telemetry signal from a downhole tool in a wellbore. In response to identifying the presence of the telemetry signal, the systems and methods may determine one or more telemetry parameters of the telemetry signal such as: modulation type, carrier frequency, symbol rate, or a combination thereof. These parameters may be shown to a user in real-time.

If, on the other hand, the parameters are unknown, (e.g., because the telemetry parameters selected at the surface do not match telemetry parameters of the telemetry signal from the downhole tool), the systems and methods may troubleshoot telemetry failures and/or provide receiver automation. In one embodiment, an alarm may be triggered in response to the parameters being unknown or unable to be determined.

Service quality (SQ) incidents in a signal demodulation issue/failure category represent a frequent cause of measurement-while-drilling (MWD) and logging-while-drilling (LWD) failures. The systems and methods may address the causes that lead to the SQ events in this category to bolster the reliability of MWD and LWD operations. Telemetry mode detection provides an efficient and consistent tool which provides real-time advice to users having trouble demodulating the telemetry signal. In some embodiments, systems and methods may automatically configure a receiver at the surface to the detected modulation type, carrier frequency, and symbol rate. The systems and methods may improve reliability by reducing the telemetry SQ events and/or promoting remote operation through automation.

Figure 2:
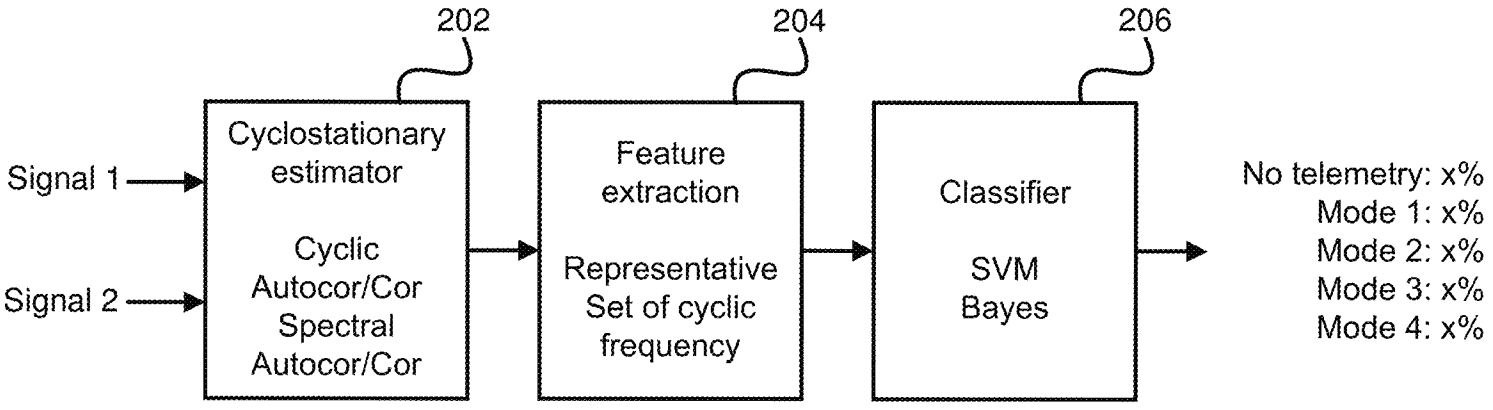
FIG. 2 illustrates a schematic view of a system for determining a telemetry mode, according to an embodiment.

FIG. 2 illustrates a schematic view of a system for determining a modulation type, a carrier frequency, and a symbol rate according to an embodiment. The system may include a cyclostationary estimator 202 that is configured to receive one or more signal inputs. FIG. 2 shows two signal inputs. However, in other embodiments cyclostationary estimator 202 may have one input or more than two inputs.

Cyclostationarity is a class of mathematical models for a large number of signals such as, for example, man-made modulated frequency signals, which could be cell phone signals, broadcast radio and television signals, WiFi models, and drilling telemetry signals. Cyclostationary signals have probabilistic parameters that vary periodically with time. Probabilistic parameters may include, but not be limited to, quantities such as mean value, variance, and higher-order moments. These probabilistic parameters may be defined for a time-domain signal and for a frequency-domain representation. Thus, there are 'temporal moments' and 'spectral moments.' A second-order spectral moment is also known as a spectral correlation function (SCF).

The inputs to cyclostationary estimator 202 may be or include one or more drilling telemetry signals that are measured at or near the surface of a wellbore. In some embodiments, the drilling telemetry signals may represent mud pulse telemetry signals and/or electric potential (EM) telemetry signals. The system may also include a feature extractor 204 that is configured to receive one or more outputs from the cyclostationary estimator and to extract features. In various embodiments, the extracted features may include one or more cyclic frequencies, which can be used to identify a modulation type. The feature extractor may select a representative subset of cyclic frequencies. The choice of which cyclic frequencies to select may be manually defined depending on the expected outcome of the classifier. The cyclic frequencies may be plotted on a graph to form spectral or cyclic autocorrelation.

The system may also include a classifier that is configured to receive one or more outputs from the feature extractor. The classifier may be or include a support vector machine. In another embodiment, the classifier may be or include a random forest classifier, a Naïve Bayes classifier, or the like. The classifier may be configured to output a probability of a telemetry mode to be transmitted.

Figure 3:
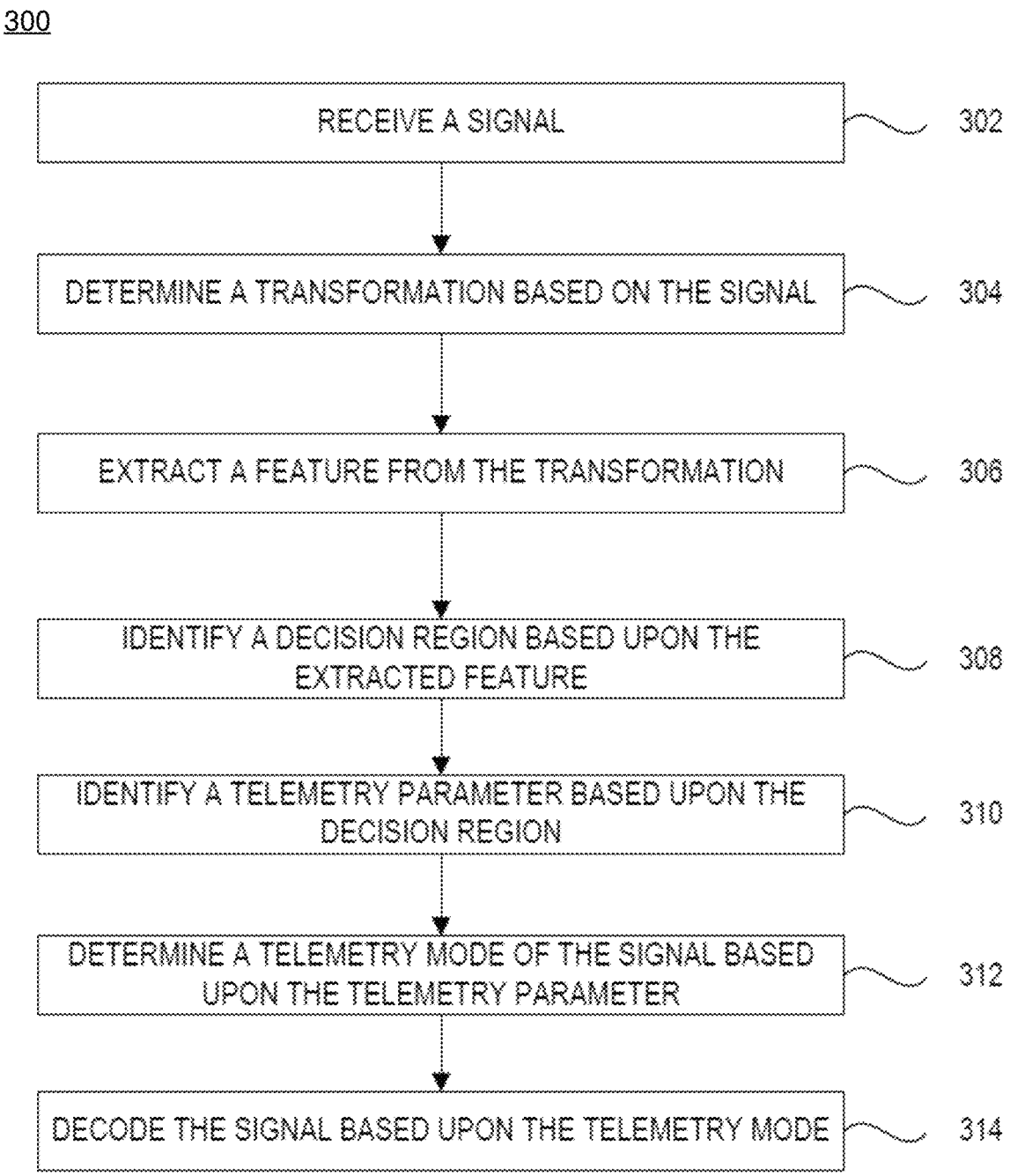
FIG. 3 illustrates a flowchart of a method for determining the telemetry mode, according to an embodiment.

FIG. 3 illustrates a flowchart of a method 300 for determining the telemetry mode, according to an embodiment. The method 300 may include receiving one or more signals, as at 302. The signals may be or include drilling telemetry signals (e.g., mud pulse telemetry and/or EM signals) that are transmitted from a downhole tool in a wellbore. The signals may be received by one or more receivers at or near the surface of a wellsite. The signals may then be transmitted from the receiver(s) to cyclostationary estimator 202.

The method 300 may also include determining one or more transformations based at least partially upon the one or more signals, as at 304. The transformations may be determined by cyclostationary estimator 202. The transformations may be or include high-order transformations such as cyclic (auto)correlation and/or spectral (auto)correlation that are based upon statistics. Cyclic statistics may be used for the detection of telemetry signals that exhibit strong cyclic features. As an example, by denoting X(f), the Fourier transform of the received signal, the cyclic autocorrelation $I^{\alpha}(f)$ is given by:

$$R_x^{\alpha}(\tau) = \lim_{T\to\infty} \frac{1}{T}\int_{-T/2}^{+T/2} x\left(t-\frac{\tau}{2}\right)x^*\left(t+\frac{\tau}{2}\right)e^{-2i\pi\alpha t}dt \tag{1}$$

The spectral autocorrelation is given by:

$$S_x^{\alpha}(f)=\int_{-\infty}^{+\infty} R_x^{\alpha}(\tau)e^{-2i\pi\alpha\tau}d\tau \tag{2}$$

In the equations, x(t) is the received signal, T is the integration window, t is time, r is the time shift, f is the frequency, (*) is the complex conjugate, a is the cycle frequency, $R_x^{\alpha}(\tau)$ is the cyclic autocorrelation function, and $S_x^{\alpha}(f)$ is the spectral correlation density. The Outputs from the cyclostationary estimator may be transmitted to the feature extractor.

Figure 5:
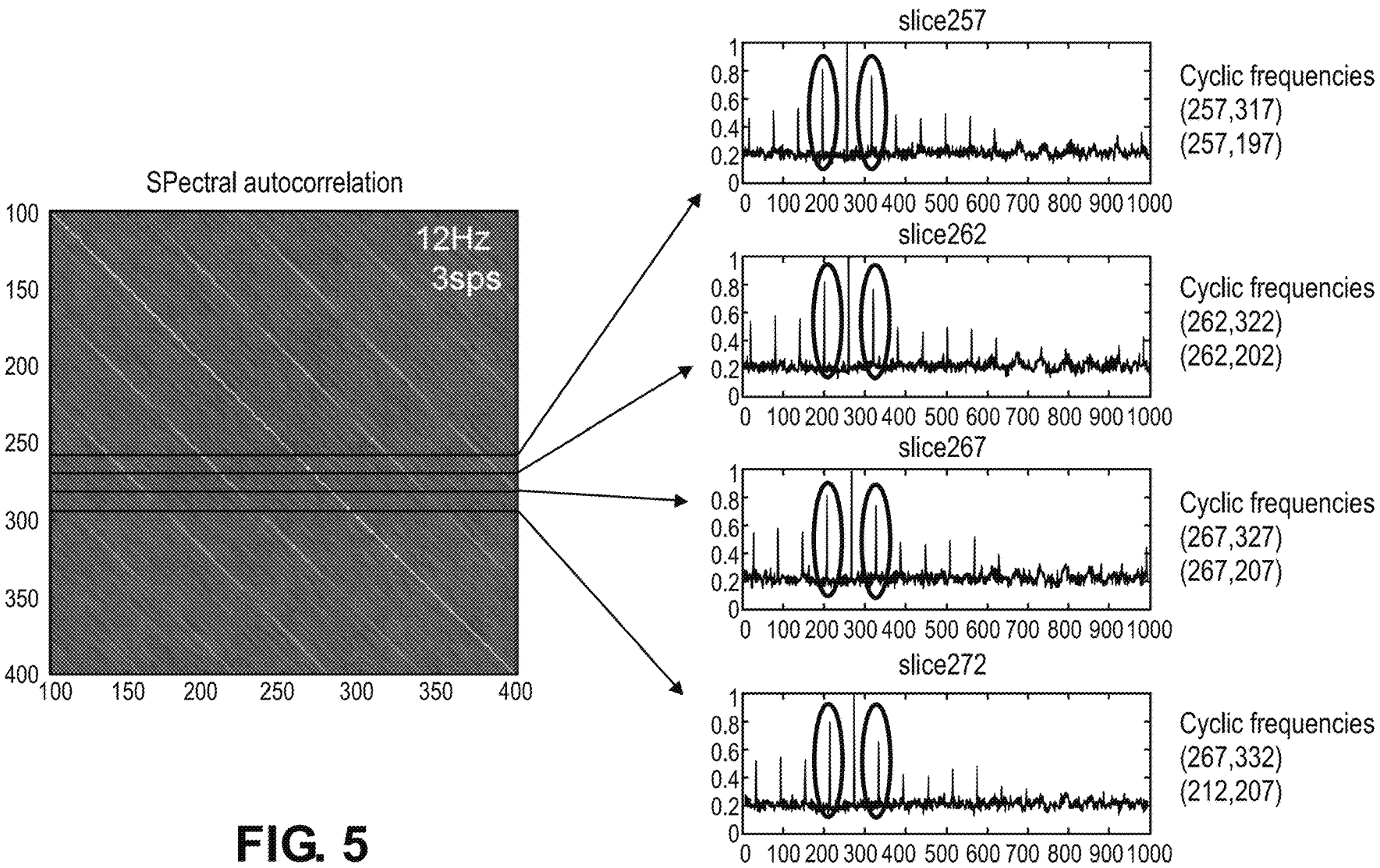
FIG. 5 illustrates a schematic view of feature extraction based on spectral autocorrelation, according to an embodiment.

The method 300 may also include extracting one or more features from the transformations (e.g., the transformed domain), as at 306. The extraction may be performed by feature extractor 204. The extracted features may be or include one or more cyclic frequencies. Because any telecommunication signal exhibits a different set of cyclic frequencies, such features can be used to identify a specific modulation type. FIG. 5 illustrates a schematic view of feature extraction based on spectral autocorrelation, according to an embodiment. The outputs from feature extractor 204 may include detected cyclic frequencies, which may be transmitted to classifier 206.

The method 300 may also include identifying one or more decision regions based at least partially upon the extracted feature(s), as at 308. The decision regions are rules learned from the data. The decision regions may be identified by classifier 206, which may determine probabilities of different classifications. The method 300 may also include identifying one or more telemetry parameters based at least partially upon the one or more decision regions, as at 310. The telemetry parameters may be identified by classifier 206. The method 300 may also include determining a telemetry mode of the signal(s) based at least partially upon the telemetry parameters, as at 312. The method 300 may also include decoding the drilling telemetry signal(s) based at least partially upon the telemetry mode, as at 314. In some embodiments, after determining the telemetry mode of the one or more signals, the system and method may automatically transmit commands to the receiver to configure the receiver for the determined telemetry mode.

The system and method may be initially trained using a variety of traces that have already been manually classified (i.e., a training dataset). In practice, classifier 206 may be trained by using a known trace at an input processing pipeline, and by iteratively modifying the parameters of classifier 206 such that its output reflects a class associated with the current trace. Repeating this procedure one or more times with a variety of traces may gradually increase the accuracy of the classifier.

Figure 4:
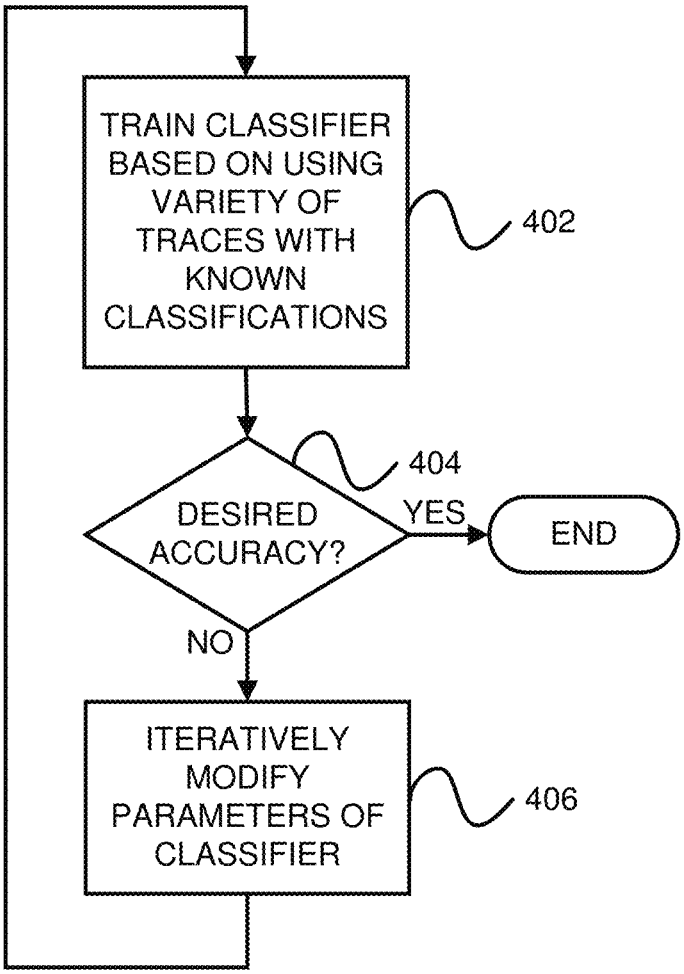
FIG. 4 illustrates a flowchart of a method for training a classifier, according to an embodiment.

FIG. 4 is a flowchart of a method for training classifier 206. As mentioned above, classifier 206 may be trained using a variety of traces that have known classifications (402). During training, classifier 206 may classify respective known traces. Classifications, by classifier 206, of the respective known traces may be compared with the known classifications to determine a level of accuracy of classifier 206. If, during 404, a determination is made that classifier 206 has reached a desired level of accuracy, then the process of training classifier 206 may be completed. Otherwise, parameters of classifier 206 may be modified in an attempt to improve the level of accuracy (406) and 402-406 may again be performed until the desired level of accuracy is reached.

Figure 6:
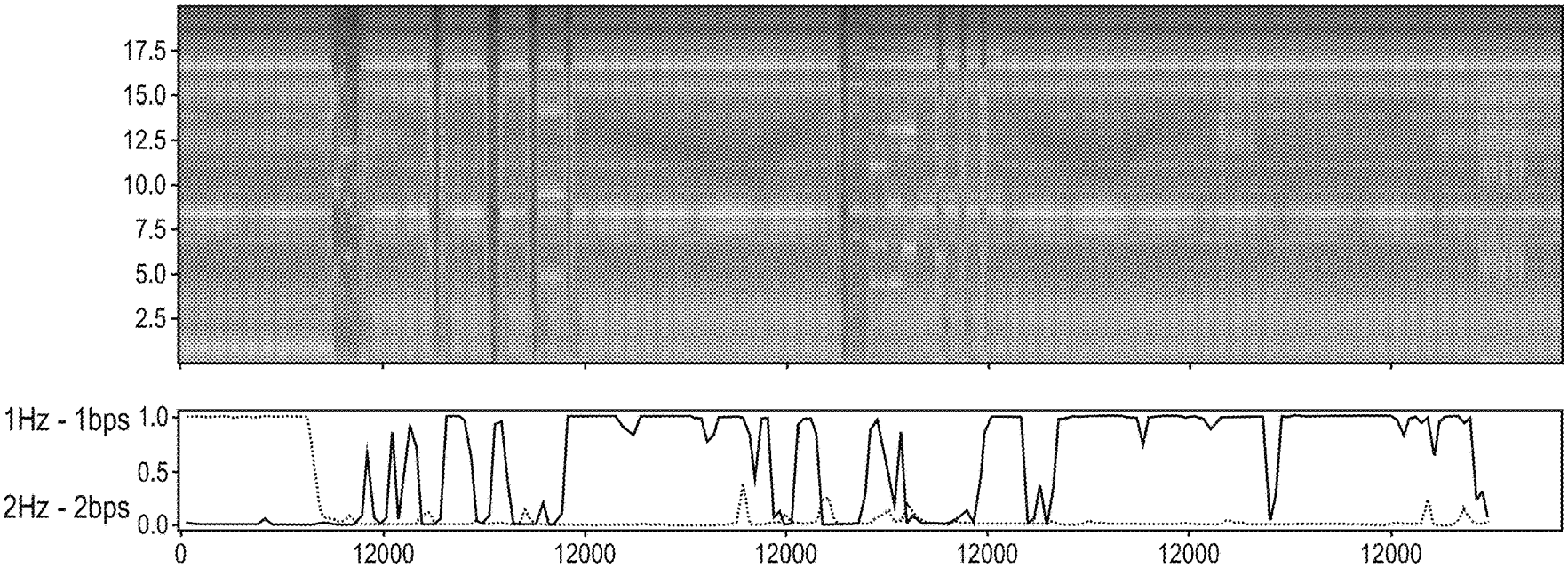
FIG. 6 illustrates a result of an inference on an unknown signal, according to an embodiment.

Once the system and method have reached the desired level of accuracy using the training dataset, the algorithm may be used for inference on unknown signals (e.g., to determine the modes of the unknown signals). FIG. 6 illustrates a result of an inference on an unknown signal, according to an embodiment. In FIG. 6, classifier 206 was able to discriminate between two telecommunication modes: (QPSK-1 Hz-1 bps) and (QPSK-2 Hz-2 bps). A top portion of FIG. 6 is a signal spectrogram, and at a bottom portion of FIG. 6 is a result of the classification. The bottom portion of FIG. 6 shows a probability of the telemetry being in a specific mode. In FIG. 6, the bottom portion shows that the signal is most likely QPSK-1 Hz-1 bps.

Figure 7:
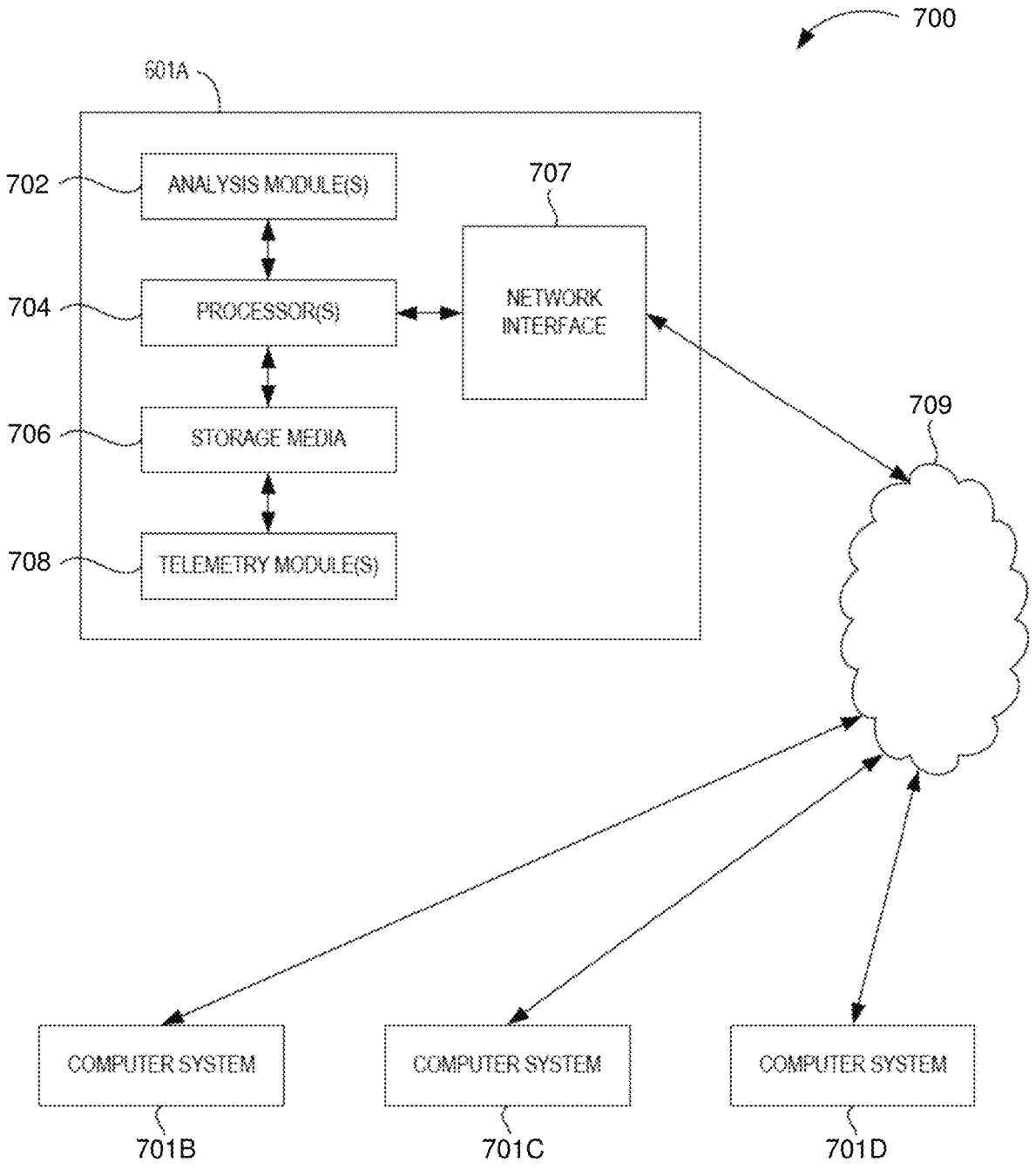
FIG. 7 illustrates a schematic view of a computing system for performing at least a portion of the method, in accordance with some embodiments.

In some embodiments, the methods of the present disclosure may be executed by a computing system. FIG. 7 illustrates an example of such a computing system 700, in accordance with some embodiments. The computing system 700 may include a computer or computer system 701A, which may be an individual computer system 701A or an arrangement of distributed computer systems. The computer system 701A includes one or more analysis modules 702 that are configured to perform various tasks according to some embodiments, such as one or more methods disclosed herein. To perform these various tasks, the analysis module 702 executes independently, or in coordination with, one or more processors 704, which is (or are) connected to one or more storage media 706. The processor(s) 704 is (or are) also connected to a network interface 707 to allow the computer system 701A to communicate over a data network 709 with one or more additional computer systems and/or computing systems, such as 701B, 701C, and/or 701D (note that computer systems 701B, 701C and/or 701D may or may not share the same architecture as computer system 701A, and may be located in different physical locations, e.g., computer systems 701A and 701B may be located in a processing facility, while in communication with one or more computer systems such as 701C and/or 701D that are located in one or more data centers, and/or located in varying countries on different continents).

One or more processors 704 may include a microprocessor, microcontroller, processor module or subsystem, programmable integrated circuit, programmable gate array, or another control or computing device.

The storage media 706 may be implemented as one or more non-transitory computer-readable or non-transitory machine-readable storage media. Note that while in the example embodiment of FIG. 7 storage media 706 is depicted as within computer system 701A, in some embodiments, storage media 706 may be distributed within and/or across multiple internal and/or external enclosures of computing system 701A and/or additional computing systems. Storage media 706 may include one or more different forms of memory including semiconductor memory devices such as dynamic or static random access memories (DRAMs or SRAMs), erasable and programmable read-only memories (EPROMs), electrically erasable and programmable read-only memories (EEPROMs) and flash memories, magnetic disks such as fixed, floppy and removable disks, other magnetic media including tape, optical media such as compact disks (CDs) or digital video disks (DVDs), BLURAY® disks, or other types of optical storage, or other types of storage devices. Note that the instructions discussed above may be provided on one non-transitory computer-readable or non-transitory machine-readable storage medium, or may be provided on multiple non-transitory computer-readable or non-transitory machine-readable storage media distributed in a large system having possibly plural nodes. Such non-transitory computer-readable or machine-readable storage medium or media is (are) considered to be part of an article (or article of manufacture). An article or article of manufacture may refer to any manufactured single component or multiple components. The storage medium or media may be located either in the machine running the machine-readable instructions, or located at a remote site from which machine-readable instructions may be downloaded over a network for execution.

In some embodiments, computing system 700 contains one or more telemetry module(s) 708 configured to perform at least a portion of the method 300. It should be appreciated that computing system 700 is merely one example of a computing system, and that computing system 700 may have more or fewer components than shown, may combine additional components not depicted in the example embodiment of FIG. 7, and/or computing system 700 may have a different configuration or arrangement of the components depicted in FIG. 7. The various components shown in FIG. 7 may be implemented in hardware, software, or a combination of both hardware and software, including one or more signal processing and/or application specific integrated circuits.

Further, the steps in the processing methods described herein may be implemented by running one or more functional modules in information processing apparatuses such as general-purpose processors or application specific chips, such as ASICs, FPGAs, PLDs, or other appropriate devices. These modules, combinations of these modules, and/or their combination with general hardware are included within the scope of the present disclosure.

Computational interpretations, models, and/or other interpretation aids may be refined in an iterative fashion; this concept is applicable to the methods discussed herein. This may include use of feedback loops executed on an algorithmic basis, such as at a computing device (e.g., computing system 700, FIG. 7), and/or through manual control by a user who may make determinations regarding whether a given step, action, template, model, or set of curves has become sufficiently accurate for the evaluation of the subsurface three-dimensional geologic formation under consideration.

The foregoing description, for purpose of explanation, has been described with reference to specific embodiments. However, the illustrative discussions above are not intended to be exhaustive or limiting to the precise forms disclosed.

Many modifications and variations are possible in view of the above teachings. Moreover, the order in which the elements of the methods described herein are illustrated and described may be re-arranged, and/or two or more elements may occur simultaneously. The embodiments were chosen and described in order to best explain the principals of the disclosure and its practical applications, to thereby enable others skilled in the art to best utilize the disclosed embodiments and various embodiments with various modifications as are suited to the particular use contemplated.

What is claimed is:

1. A method for determining a telemetry mode of a signal, the method comprising:

receiving a drilling telemetry signal from a downhole tool in a wellbore;

determining, by a cyclostationary estimator, a transformation based at least partially upon the drilling telemetry signal;

extracting a plurality of features based at least partially upon the transformation, wherein the features comprise a plurality of cyclic frequencies;

identifying a decision region based at least partially upon the features;

identifying a telemetry parameter based at least partially upon the decision region, wherein the telemetry parameter is based upon a subset of the cyclic frequencies;

determining a telemetry mode of the drilling telemetry signal based at least partially upon the telemetry parameter; and decoding the drilling telemetry signal based at least partially upon the determined telemetry mode of the drilling telemetry signal.

2. The method of claim 1, wherein the drilling telemetry signal is a mud pulse telemetry signal or an electric potential telemetry signal.

3. The method of claim 1, further comprising:

automatically configuring a receiver to receive drilling telemetry signals using the determined telemetry mode.

4. The method of claim 1, wherein the drilling telemetry signal is received at or near a surface of the wellbore.

5. The method of claim 1, wherein:

the decision region is identified by a classifier, and the classifier includes a support vector machine.

6. The method of claim 1, wherein:

the decision region is identified by a classifier, and the classifier includes one from a group consisting of a random forest classifier and a Naïve Bayes classifier.

7. The method of claim 1, further comprising:

training a classifier based on using a variety of traces with known classifications;

iteratively modifying parameters of the classifier such that output of the classifier reflects a class associated with a current trace; and repeating the training and the iteratively modifying until the classifier reaches a desired level of accuracy, wherein the classifier identifies the decision region based at least partially upon the features.

8. The method of claim 1, further comprising receiving two or more signals, wherein at least one of the two or more signals comprises the drilling telemetry signal from the downhole tool in the wellbore, wherein one of the two or more signals comprises a mud pulse telemetry signal, and the other of the two or more signals comprises an electromagnetic (EM) telemetry signal, and wherein the transformation is based at least partially upon the two or more signals.

9. The method of claim 1, wherein the transformation comprises a cyclic autocorrelation or a spectral autocorrelation.

10. The method of claim 1, wherein determining the telemetry mode comprises generating a signal spectrogram based at least partially upon the telemetry parameter.

11. The method of claim 10, wherein determining the telemetry mode also comprises determining a first probability that the drilling telemetry signal is in a first telemetry mode, and a second probability that the drilling telemetry signal is in a second telemetry mode.

12. A non-transitory computer-readable medium storing instructions that, when executed by at least one processor of a computing system, cause the computing system to perform operations, the operations comprising:

receiving a drilling telemetry signal from a downhole tool in a wellbore;

determining, by a cyclostationary estimator, a transformation based at least partially upon the drilling telemetry signal;

extracting a plurality of features based at least partially upon the transformation, wherein the features comprise a plurality of cyclic frequencies;

identifying a decision region based at least partially upon the features;

identifying a telemetry parameter based at least partially upon the decision region, wherein the telemetry parameter is based upon a subset of the cyclic frequencies;

determining a telemetry mode of the drilling telemetry signal based at least partially upon the telemetry parameter; and decoding the drilling telemetry signal based at least partially upon the determined telemetry mode of the drilling telemetry signal.

13. The non-transitory computer-readable medium of claim 12, wherein the drilling telemetry signal is a mud pulse telemetry signal or an electric potential telemetry signal.

14. The non-transitory computer-readable medium of claim 12, wherein the operations further comprise:

automatically configuring a receiver to receive drilling telemetry signals using the determined telemetry mode.

15. The non-transitory computer-readable medium of claim 12, wherein the drilling telemetry signal is received at or near a surface of the wellbore.

16. The non-transitory computer-readable medium 8, wherein:

the decision region is identified by a classifier, and the classifier includes a support vector machine.

17. The non-transitory computer-readable medium of claim 12, wherein:

the decision region is identified by a classifier, and the classifier includes one from a group consisting of a random forest classifier, and a Naïve Bayes classifier.

18. The non-transitory computer-readable medium of claim 12, wherein the operations further comprise:

training a classifier based on using a variety of traces with known classifications;

iteratively modifying parameters of the classifier such that output of the classifier reflects a class associated with a current trace; and repeating the training and the iteratively modifying until the classifier reaches a desired level of accuracy, wherein the classifier identifies the decision region based at least partially upon the features.

19. A computing system comprising:

one or more processors; and a memory system comprising one or more non-transitory computer-readable media storing instructions that, when executed by at least one of the one or more processors, cause the computing system to perform operations, the operations comprising:

receiving two or more signals, wherein at least one of the two or more signals comprises a drilling telemetry signal from a downhole tool in a wellbore, wherein one of the two or more signals comprises a mud pulse telemetry signal, and the other of the two or more signals comprises an electromagnetic (EM) telemetry signal;

determining, by a cyclostationary estimator, a transformation based at least partially upon the two or more signals;

extracting a plurality of features based at least partially upon the transformation, wherein the features comprise a plurality of cyclic frequencies;

identifying a decision region based at least partially upon the features;

identifying a telemetry parameter based at least partially upon the decision region;

determining a telemetry mode of the drilling telemetry signal based at least partially upon the telemetry parameter; and decoding the drilling telemetry signal based at least partially upon the determined telemetry mode of the drilling telemetry signal.

* * * * *